US012320118B2

(12) United States Patent
Leung For Sang

(10) Patent No.: US 12,320,118 B2
(45) Date of Patent: Jun. 3, 2025

(54) COMPOSITE FLOOR BEAM

(71) Applicant: Fat Kee Leung For Sang, London (GB)

(72) Inventor: Fat Kee Leung For Sang, London (GB)

( * ) Notice: Subject to any disclaimer, the term of this patent is extended or adjusted under 35 U.S.C. 154(b) by 0 days.

(21) Appl. No.: 18/579,050

(22) PCT Filed: Jul. 14, 2022

(86) PCT No.: PCT/GB2022/051822
§ 371 (c)(1),
(2) Date: Jan. 12, 2024

(87) PCT Pub. No.: WO2023/285823
PCT Pub. Date: Jan. 19, 2023

(65) Prior Publication Data

US 2024/0263450 A1 Aug. 8, 2024

(30) Foreign Application Priority Data

Jul. 14, 2021 (GB) ..... 2110149

(51) Int. Cl.
*E04C 3/292* (2006.01)

(52) U.S. Cl.
CPC ..... *E04C 3/292* (2013.01)

(58) Field of Classification Search
CPC . E04C 3/292; E04C 3/29; E04C 3/291; E04C 3/145; E04C 3/18
See application file for complete search history.

(56) References Cited

U.S. PATENT DOCUMENTS 1,644,940 A * 10/1927 Moyer ..... E04C 3/086 52/634
1,741,423 A * 12/1929 Lachman ..... E04C 3/086 29/415

(Continued)

FOREIGN PATENT DOCUMENTS

| | | | |
|---|---|---|---|
| AU | 2004222747 | A1 | 5/2005 |
| EP | 1957726 | B1 | 3/2009 |
| WO | 2015120865 | A1 | 8/2015 |

OTHER PUBLICATIONS

WO2023285823 International Search Report, Oct. 2022.
WO2023285823 Written Opinion of the ISA, Oct. 2022.

*Primary Examiner* — Rodney Mintz
(74) *Attorney, Agent, or Firm* — CrossPond Law

(57) ABSTRACT

The invention relates to a composite floor beam for use in construction. The composite floor beam comprises an upper part made from a first material extending substantially along the length of the beam and a lower part made from a second material such as metal extending substantially along the length of the beam, the upper part comprises an upper surface and a lower surface. The lower part comprises an upper surface and a lower surface. The upper surface of the upper part is designed to be arranged horizontally to support a floor above. The upper surface of the upper part is parallel to the lower surface of the lower part. The lower surface of the lower part is designed to be arranged horizontally for attachment to a ceiling below. The lower surface of the upper part and the upper surface of the lower part define apertures between them for cabling and/or piping and/or other utilities. The apertures pass from a first side of the beam to a second side of the beam. The direction of the apertures passing from the first side to the second side being transverse to the direction of the length of the beam.

19 Claims, 15 Drawing Sheets

(56) References Cited

U.S. PATENT DOCUMENTS

| | | | | |
|---|---|---|---|---|
| 3,263,387 | A * | 8/1966 | Simpson | E04C 3/083 52/634 |
| 3,345,792 | A | 10/1967 | Chandler | |
| 3,481,091 | A * | 12/1969 | Serna | E04C 3/22 52/433 |
| 4,228,631 | A | 10/1980 | Geffe | |
| 8,176,710 | B2 * | 5/2012 | Davidson, III | E04C 3/36 52/856 |
| 8,434,279 | B2 * | 5/2013 | Kim | E04C 3/291 52/841 |
| 2005/0086898 | A1 * | 4/2005 | Robak | E04C 3/291 52/843 |
| 2008/0216439 | A1 | 9/2008 | Davidson et al. | |
| 2011/0265422 | A1 * | 11/2011 | Kim | E04C 3/291 29/897.35 |

* cited by examiner

COMPOSITE FLOOR BEAM

The invention relates to a composite floor beam.

Known floor beams will now be described with reference to the accompanying drawings, in which, FIG. 1 is an exploded perspective view of a known ribbed timber floor, FIG. 2A is a perspective view of the ribbed timber floor of FIG. 1 in assembled form, FIG. 2B is an end view of the known ribbed timber floor of FIG. 2A, FIG. 3 is an exploded view of a known Composite Steel and Timber Beam, and FIG. 4A is a perspective view of the Composite Steel and Timber Beam of FIG. 3 in assembled form, FIG. 4B is an end view of the Composite Steel and Timber Beam of FIG. 3, Referring to FIGS. 1, 2A and 2B, a prefabricated ribbed floor panel 10 is commercially available from Cross Laminated Timber (known as CLT) suppliers KLH and Stora Enso. A timber floor slab 12 is glued to Glued Laminated Timber (known as Glulam) beams 14 to form a composite floor which is stiffer in bending that the sum of the two elements considered separately. The panels 10 are prefabricated which allows for rapid site erection, and disassembly at the end of life of the building.

Referring to FIG. 2A, the typical span A1 of the ribbed floor panel 10 is 6 to 10 metres (19.7 to 32.8 feet). Referring to FIG. 2A, the typical slab thickness B1 is 110 mm (4.33 inches). Referring to FIG. 2A, the typical beam depth C1 is 240 mm (9.45 inches) to 600 mm (23.6 inches). Referring to FIG. 2A, the typical distance from centre to centre of beam D1 is 600 mm (23.6 inches) to 1200 mm (47.24 inches).

A problem with the prefabricated ribbed floor panel 10 is that large regular openings through the timber beams are not possible, because wood is an anisotropic material.

The use of steel beams in composite action with timber floor panels has been achieved in an experimental setting as documented by a research paper called "Innovative composite steel-timber floors with prefabricated modular components" by Loss and Davison (2017). Referring to FIGS. 3, 4A and 4B, such a composite steel and timber beam 20 comprises a steel beam 24 constructed from folded plates welded together. Fastener seats (not shown for conciseness) are welded to the underside of the steel beam. Screws 26 are inserted through the fastener seats into the floor slab 22 to create a composite steel and timber beam 20, which is stiffer in bending that the sum of the individual beam 24 and slab 22.

Referring to FIGS. 4A and 4B, the typical span A2 of the composite steel and timber beam 20 is 5.84 metres (19.2 feet). The typical slab thickness B2 is 85 mm (3.34 inches). The typical beam depth C2 is 200 mm (7.87 inches). The typical distance from centre to centre of beam D2 is (47.24 inches)

This technique is suitable for short span structures because it can be assembled in a factory and brought to site in small panels and placed on supporting beams.

For long span structures involving large bays of floors, the transport and craning of large factory-assembled composite steel and timber beams 20, in particular manoeuvring cumbersome beams 20 on building sites constrained in terms of size poses a health and safety hazard.

If the individual components 22, 24, 26 of the composite steel and timber beams 20 are assembled on a building site, this too poses a health and safety hazard because it involves standing below the composite steel and timber beam 20, and pressing upwards to fasten a large number of screws.

An aim of the present invention is to provide an improved, or at least an alternative, composite (structural) floor beam.

According to a first embodiment of the invention there is provided a composite (structural) floor beam.

According to a second embodiment of the invention there is provided a floor panel assembly.

According to a third embodiment of the invention there is provided a floor assembly.

According to a fourth embodiment of the invention there is provided a method of making a composite floor beam.

Other optional and preferred features of embodiments of invention are set out in the dependent claims, and the description, below. It will be appreciated that the features of the independent claims can be combined in any complimentary manner, with one or more features of another independent claim, the dependent claims, and/or with one or more features of the description, where such a combination of features would provide a working embodiment of the invention.

A composite floor beam in accordance with an embodiment of the invention will now be described, by way of example only, with reference to the accompanying drawings, in which, FIG. 5A is an exploded perspective view of a composite floor beam, FIG. 5B is a perspective view of a composite floor beam, FIG. 6A is an end view, in cross section, of an assembled composite floor beam, FIG. 6B is a perspective of an assembled composite floor beam, FIG. 7 is a schematic side view of a composite floor beam, FIG. 8A is a side view of a step of a pre-cambering process, FIG. 8B is a side view of a subsequent step of a pre-cambering process, FIG. 9A is an exploded perspective view showing a step of making a floor panel assembly, in particular joining a timber floor slab to a composite floor beam, FIG. 9B is a perspective view showing an assembled floor panel assembly, FIG. 9C is another perspective view showing hidden elements of the assembled floor panel assembly of FIG. 9B, FIG. 10 is an exploded schematic perspective view of a floor bay assembly of composite beams and a floor panel, FIG. 11A is a schematic perspective view of an assembled floor bay assembly of composite beams and a floor panel, FIG. 11B is a schematic perspective view of an assembled floor bay assembly of composite beams and a floor panel, showing hidden elements, FIG. 12A is a perspective view of a composite floor panel assembly, FIG. 12B is an end view of the composite floor panel assembly of FIG. 12A, FIGS. 13A, 13B, 14A, 14B, 15A, and 15B show selected steps in method of manufacture, specifically, FIG. 13A shows a perspective view of a process step being carried out on an engineered timber panel, FIG. 13B shows a perspective view of a process step being carried out on an I sectioned beam, FIG. 14A shows a perspective view of a process step being carried out on parts of timber panel, FIG. 14B shows a perspective view of a process step being carried out on parts of steel beam, FIG. 15A shows a perspective view of a process step being carried out on a timber part and steel part, And FIG.

15B shows a perspective view of a process step being carried out on a timber part and steel part.

Referring to FIGS. 5A and 5B, an embodiment of the invention is a composite (or hybrid) timber/steel floor beam 30, for use in construction in a floor panel assembly 90 and a floor assembly 100 (both described below with reference to FIGS. 9 to 12).

Referring to FIGS. 5A and 5B, the floor beam 30 comprises an upper part 32 made from a first material extending substantially along the length of the beam. The floor beam 30 also comprises a lower part 34 made from a second material such as metal (preferably steel) extending substantially along the length of the beam. The upper part 32 has an upper surface 40 and a lower surface 42. The lower part 34 has an upper surface 51 and a lower surface 52. The upper surface 40 of the upper part 32 is designed to be arranged horizontally to support a floor panel above. The upper surface 40 of the upper part 32 is parallel to the lower surface 52 of the lower part 34. The lower surface 52 of the lower part 34 is designed to be arranged horizontally for attachment to a ceiling panel (not shown for conciseness) below.

Referring to FIG. 5B, the lower surface 42 of the upper part 32 and the upper surface 51 of the lower part 34 define apertures 36 between them for cabling and/or piping and/or other utilities.

The upper part 32 is cut out of engineered timber panels in a standardised wave pattern, in an inventive method described in detail below with reference to FIGS. 13A and 14A.

The upper part 32 has a cellular configuration. The upper part 32 is cut out of engineered timber panels which is able to carry stresses in two co-planar orthogonal directions. This allows forces and weights supported by the beam 30 to be carried around the apertures 36. The flow of forces is described further below.

The lower part 34 is formed by cutting a universal steel I section beam using a standardised pattern (as described in detail below with reference to FIGS. 13B and 14B).

When joining the upper part 32 and the lower part 34, openings 36 are formed within the depth of the hybrid beam 30. These openings 36 allow for the routing of services through the beam in a building context. The apertures 36 passing from a first side 38 of the beam to a second side 39 of the floor beam 30. The direction of the apertures 36 passing from the first side 38 to the second side 39 being perpendicular (or otherwise transverse) to the direction of the length of the beam. These features are described in detail hereunder.

Referring to FIG. 5A, the lower surface 42 of the timber upper part has an irregular distance from the upper surface 40 of the timber upper part 32. In the embodiment shown, the lower surface of the timber upper part is wave like. In other words, the lower surface 42 of the timber upper part 32 comprises a plurality of depending tabs 43, and recesses 44 between depending tabs.

Referring to FIG. 5A, and FIG. 6A and FIG. 6B, the lower surface 42 of the timber upper part 32 comprises a plurality of upstanding slots 46 (not all shown for conciseness and clarity) running in the direction of the length of the timber upper part 32, extending from each of the lowest points of the lower surface 42 of the timber upper part 32. Each upstanding slot 46 extends to roughly the mid point of the distance from the lowest point of lower surface 42 to the highest point of lower surface.

Referring to FIG. 5A, the steel lower part 34 has an upstanding member 54 running along at least part of its length, protruding upwardly from a horizontally aligned flange part 50.

The upper surface 51 of the upstanding member 54 has an irregular distance from the lower surface 52 of the flange part 50. In the embodiment shown, the upper surface 51 of the upstanding member 54 of the steel lower part 34 is wave like. In other words, the upper surface 51 of the lower part 34 comprises a plurality of upstanding tabs 55, and recesses 56 between upstanding tabs 55.

Referring to FIGS. 5A, 6A and 6B, the upstanding member 54 of the steel lower part 34 engages with the upstanding slots 46 of the timber upper part 32.

Referring to FIG. 5B, the irregular lower surface of the upper part rests on a horizontally aligned part of the metal lower part. The upper surface 40 of the upper part 32 becomes the upper surface of the floor beam 30. The lower surface 52 of the flange part 50 becomes the lower surface of the floor beam 30.

Referring to FIG. 5A, both ends of the upper part and/or both ends of the lower part are identical in terms of distance from the upper surface 40 of the upper part 32 to the lower surface 42. Also, the waves/tabs of the upper part are in phase with the waves/tabs of the lower part. These features have the advantage of standardisation, hence easier assembly.

Aspects of the manufacturing process are shown in FIGS. 13 to 15.

Fabrication will be based on efficiency of outputs, minimal waste production and using existing automated machine tools technology. The fabrication process involves cutting an engineered timber panel in alternated waved and straight cuts. Similar waved cuts are made into steel beams at matching pitch to the waves cut in the timber. Slots are created into the protruding teeth of the timber panel and aligned with the steel. The web of the steel is inserted into the slot and the assembled secured with steel dowels 57 (or other fasteners) to allow the transfer of forces between timber and steel. Steps are explained in images below.

Referring to FIG. 13A, alternated waved cuts 70 and straight cuts 72 are made into an engineered timber panel 69. The wave form cut is about half way between straight cuts, so that adjacent timber parts 32 form mirror images of each other where the tabs 43 are out of phase with each other.

Referring to FIG. 13B, a waved cut 74 is made into web of I section steel beam. The pitch of waved cut 74 matches the waved cuts 70 made into the engineered timber panel 69. The wave form cut 74 is about half way between upper and lower flanges of I section steel beam, so that adjacent steel parts 34 form mirror images of each other where the tabs 55 are out of phase.

Referring to FIG. 14A, the parts 32 of the panelised timber panel 69 are separated and a series of slots 46 is cut in the protruding tabs 43.

Referring to FIG. 14B, the parts 34 of the steel beam are separated.

Referring to FIG. 15A, the individual pieces of timber 32 and steel 34 are brought together and the protruding tabs 43, 55 are aligned.

Referring to FIG. 15B, the web of the steel beam is pushed into the slot cut in the timber and the assembly is secured with steel dowels 57.

Referring to FIG. 6A, the steel dowels 57 extend through the upstanding tab 54, from one side of the first part 32 almost to the other side. In one convenient embodiment, ten fasteners 57 are used to connect each pair of tabs 43, 55.

FIG. 6B shows the upstanding tab 54 penetrating into the first part 32, and ten fasteners 57 connecting each pair of tabs 43, 55.

The profile of the slots 46 is complementary to the profile of the upper surface of the upstanding member 54 of the steel lower part 34.

Referring to FIG. 7, the profile of the lower surface 42 of the timber upper part 32 is somewhat similar to the profile of the upper surface 51 of the lower part 34. However, the amplitude of the wave form of the lower surface 42 of the timber upper part 32 is larger than that of the upper surface 51 of the lower part 34.

FIG. 7 shows the structural action of the beam 30, and resolution of forces around openings 36. As the beam is subjected to shear and bending under load, the shear force is carried as rationalised diagonal struts and ties around the openings. The pitch and geometry of the opening 36 allows such diagonal ties 80 and struts 82 to form and resolve at intersecting node points (which coincide with each group of fasteners 57) into the rationalised shear and coupled horizontal struts 81 and horizontal ties 83. Only one of ten fasteners 57 shown at one of the connection points between the timber and the steel is referenced in FIG. 7 so the reference numerals do not obscure clarity). As the timber part 32 is engineered to resist planar forces in the x and y orthogonal directions, the diagonal forces within the timber part 32 can be resisted orthogonally into their x and y components. The steel dowels 57 connection at the toothed profile enables the horizontal transfer of shear forces between the timber part 32 and steel part 34.

Referring to FIGS. 8A and 8B, as part of the fabrication process of the composite beam 30, pre-cambering is possible which would confer the assembled beam a predefined curvature. This is achieved by forcing (under its own load or its own load plus an additional load) the upper surface 40 of the timber upper part 32 against spaced point supports 85 which supports together define the required curve or camber on the beam. Referring to FIG. 8B, the steel part 34 is introduced into the timber part 32 and the parts are assembled into a beam 30. The curvature or camber C is locked-in once the steel parts and timber part of the beam 30 are joined with dowels 57.

Once a beam 30 is installed on site, timber upper part 32 facing up, it flattens under the self-weight of the floor panel to provide a (flat upper surface 40 and a) levelled floor plate.

Referring to FIGS. 9A, 9B and 9C, a floor panel assembly 90 comprises a composite floor beam 30 joined to a timber floor panel 88. The top of the hybrid beam 30 is of course timber. This makes it possible to form a timber-to-timber construction with the engineered timber floor slabs utilising known techniques such as screws and glues as depicted in FIGS. 9A, 9B and 9C. If screws only are adopted, it presents the opportunity of unscrewing the assembly 90 and re-using the hybrid beam 30 and timber floor plate 88 elsewhere, e.g. on another building. Joining the composite floor beam 30 to the timber panel 88 can be undertaken safely by operatives standing on top of the floor panel pressing downwards to screw the slab 88 into the upper part 32 of the composite floor beam 30 below using screws 89.

Joining the timber floor panel 88 to the composite beam 30 forms a stiff composite section in bending. Most of the bending forces arise in the engineered floor panel 88 and in the horizontal flange 50 of the steel lower part 34. The forces are opposite in direction but equal in magnitude for equilibrium. Steel can resist larger bending stresses than timber and thus the smaller cross-sectional area of steel allows it to resist an equal bending force that would be generated from a larger cross-sectional area of the timber floor plate. This allows the composite beam to be kept to manageable proportions whilst maximising the stiffness of the composite beam in the floor panel assembly 90.

Joining the floor panel 88 to the hybrid beam 30 forms a composite unit 90 which is stiffer in bending than the sum of the individual parts considered separately. As the composite unit bends under load, tension develops in the horizontal flange 50 of the steel lower part 34 while compression develops in the timber slab 88. The compression and tension forces are similar in magnitude for static equilibrium. As steel has a higher modulus of elasticity than timber, it allows higher stresses, proportional to the steel to timber modular ratio, to develop. Thus, the same force generated in the timber slab can be condensed in a smaller area of steel. This allows the hybrid beam 30 to be kept to manageable proportions for site assembly.

If the timber floor slab 88 is connected to the composite floor beam 30 of the floor panel assembly 90 before it arrives on site, services should be installed into the openings 36 from below.

Referring to FIG. 10, another embodiment of the invention is a floor assembly 100 made incorporating a composite timber/steel floor beam 30.

A floor assembly 100 comprises a plurality of support columns 102, and a plurality of composite floor beams 30, joined to a floor panel 104 (optionally joined to a ceiling panel) using screw fasteners 106. Indicative services 108 (cabling and/or piping and/or other utilities) are shown running through the openings in the hybrid beams 30.

As an alternative to the embodiment shown in FIG. 10, a floor assembly 100 can comprise a plurality of support columns 102, and a plurality of floor panel assembly 90 optionally joined to a ceiling panel).

Figure 1:
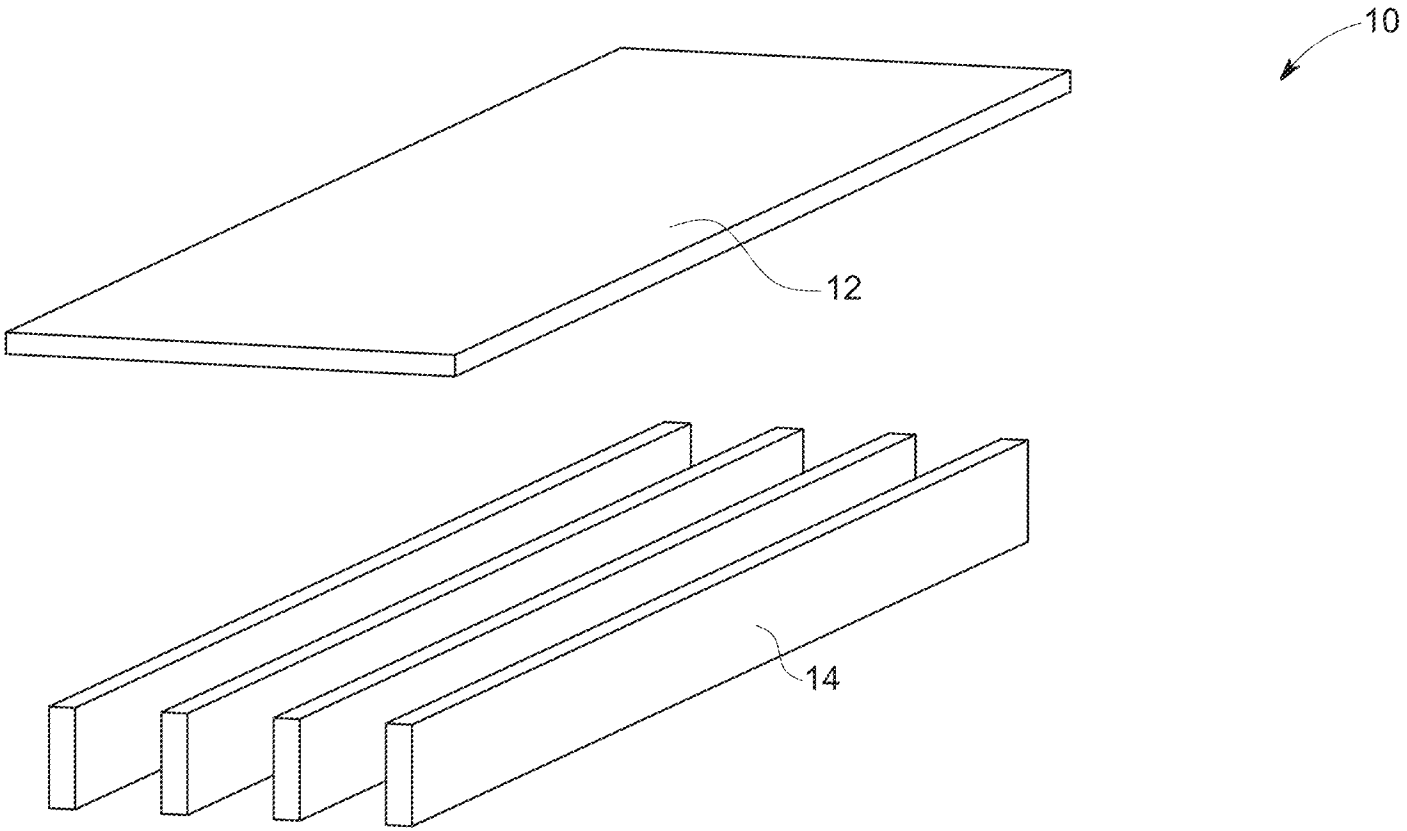
FIGURE 1 (PRIOR ART)
Figure 2A:
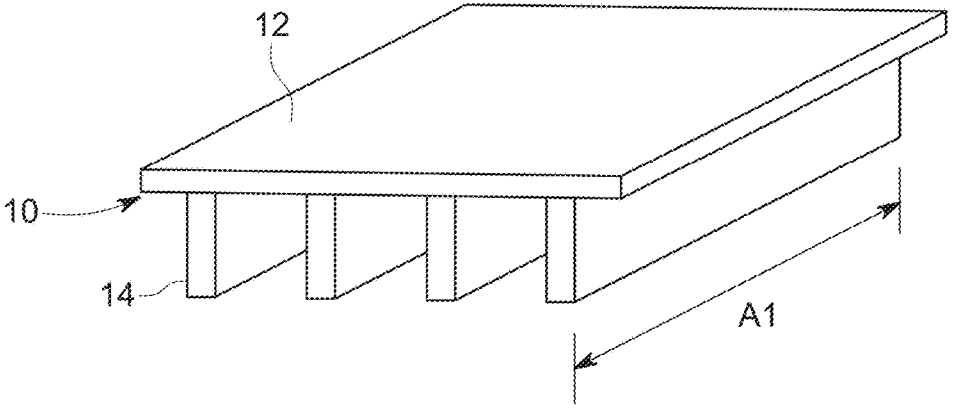
FIGURE 2A (PRIOR ART)
Figure 2B:
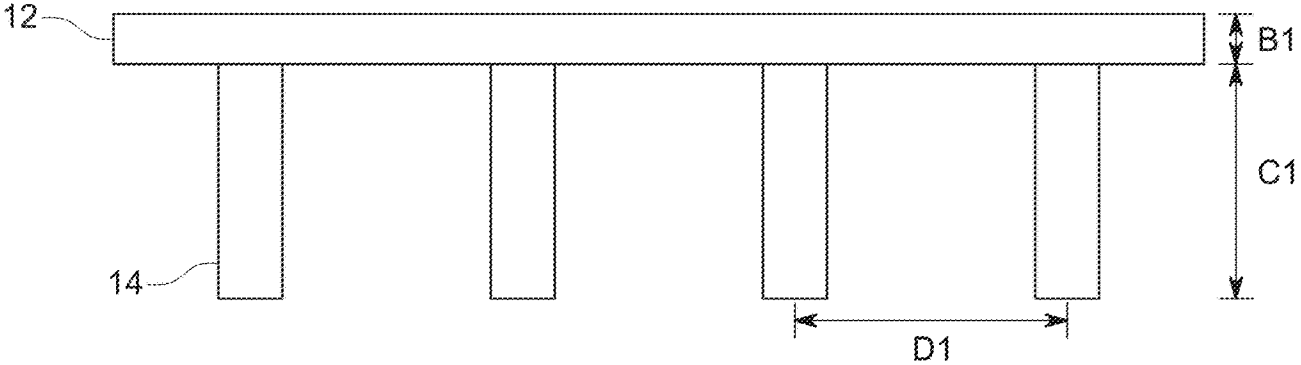
FIGURE 2B (PRIOR ART)
Figure 3:
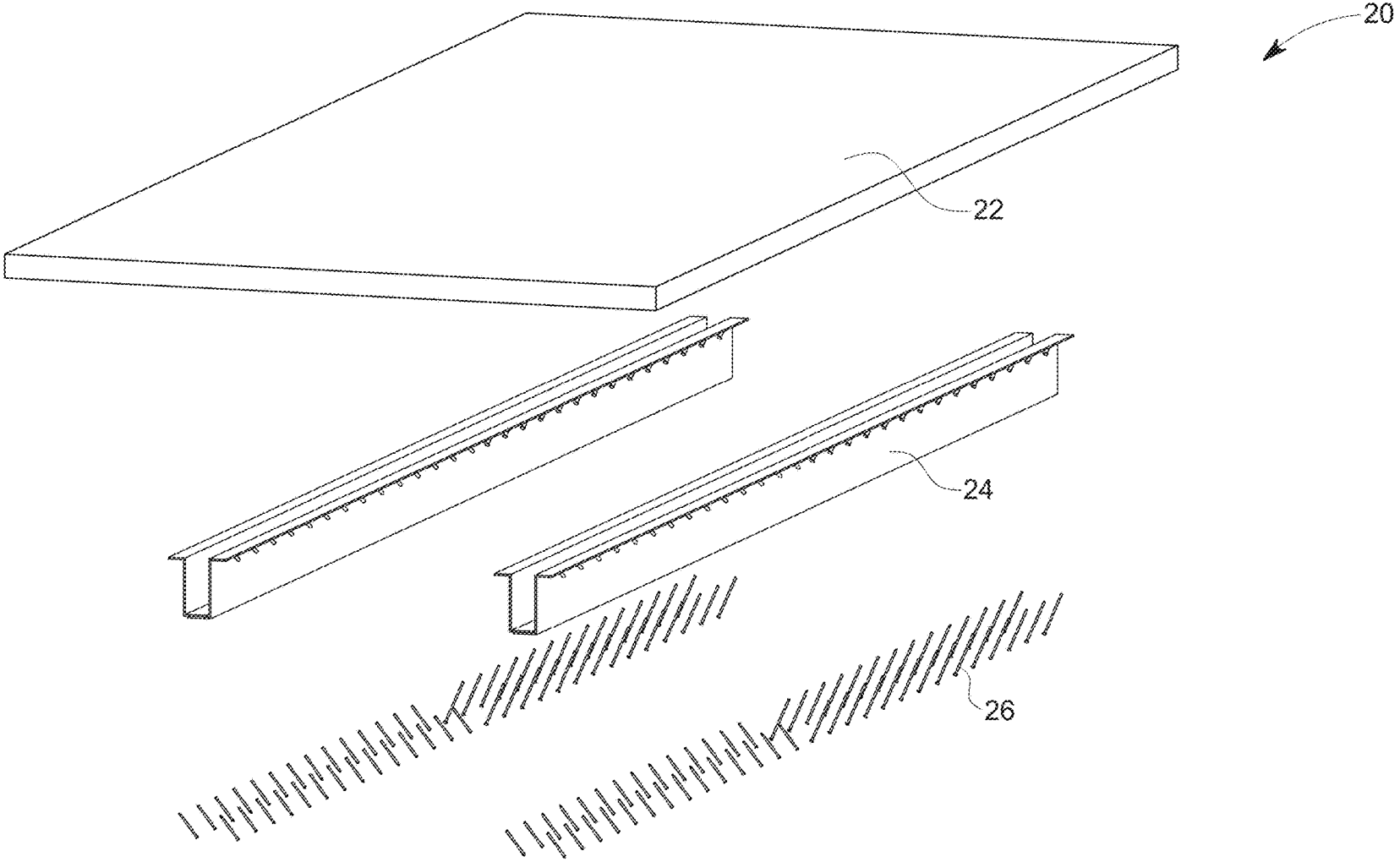
FIGURE 3 (PRIOR ART)
Figure 4A:
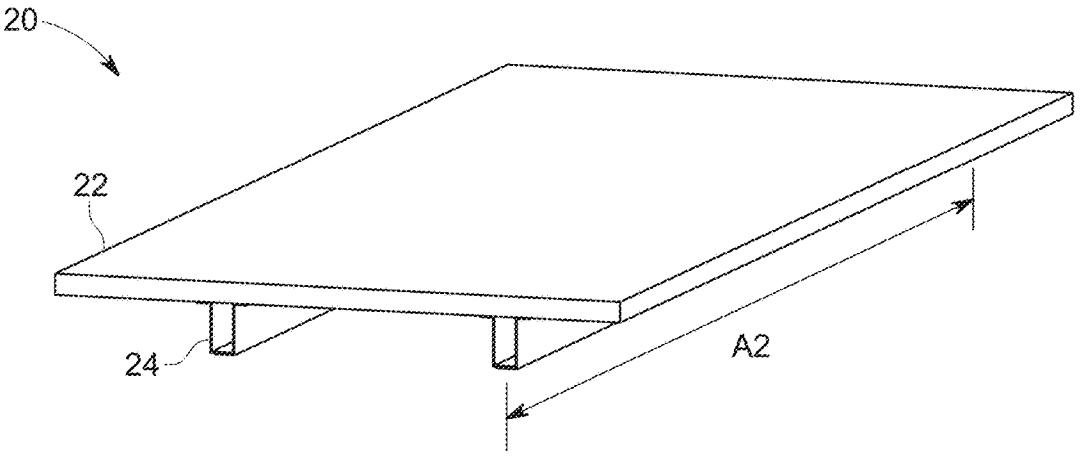
FIGURE 4A (PRIOR ART)
Figure 4B:
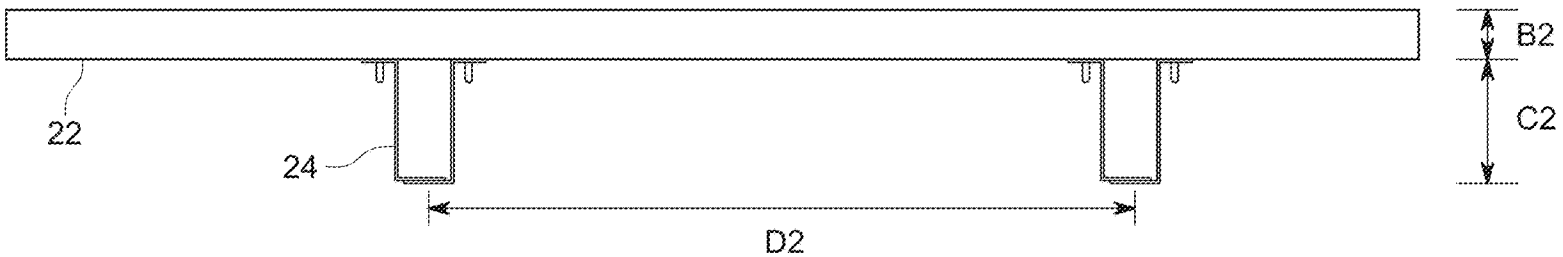
FIGURE 4B (PRIOR ART)
Figure 5A:
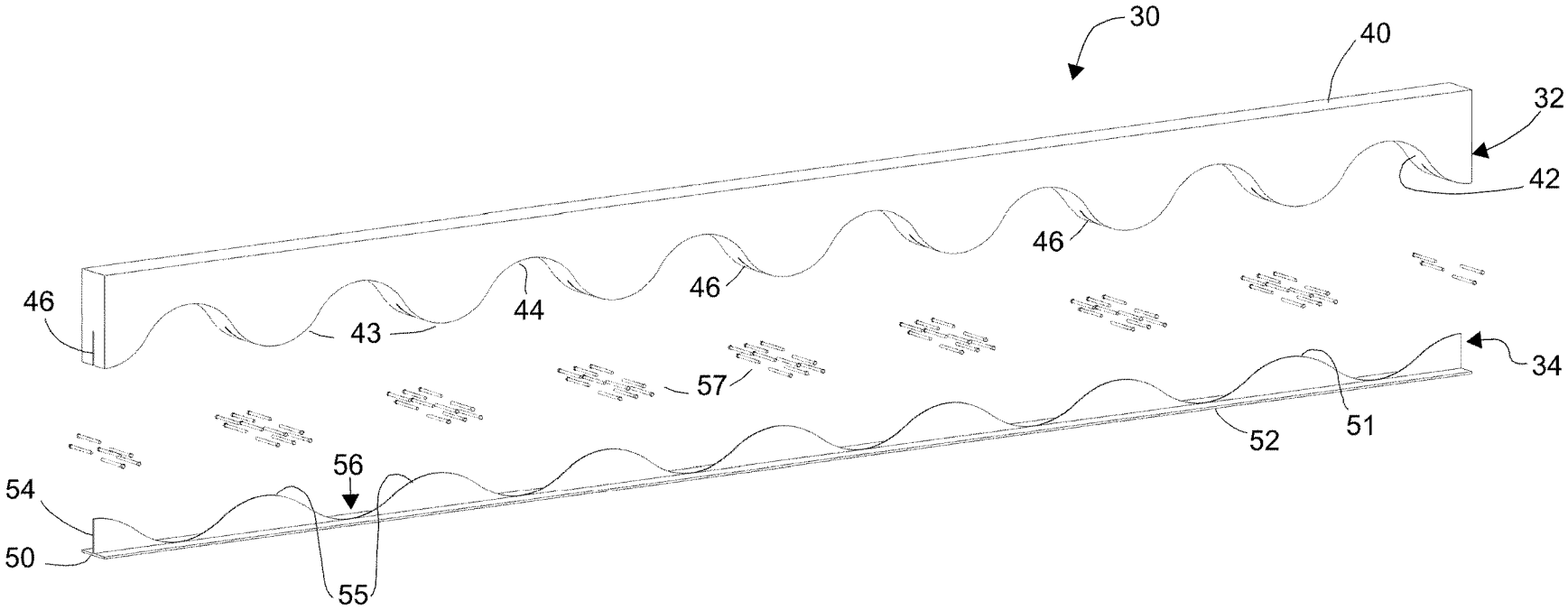
Figure 5B:
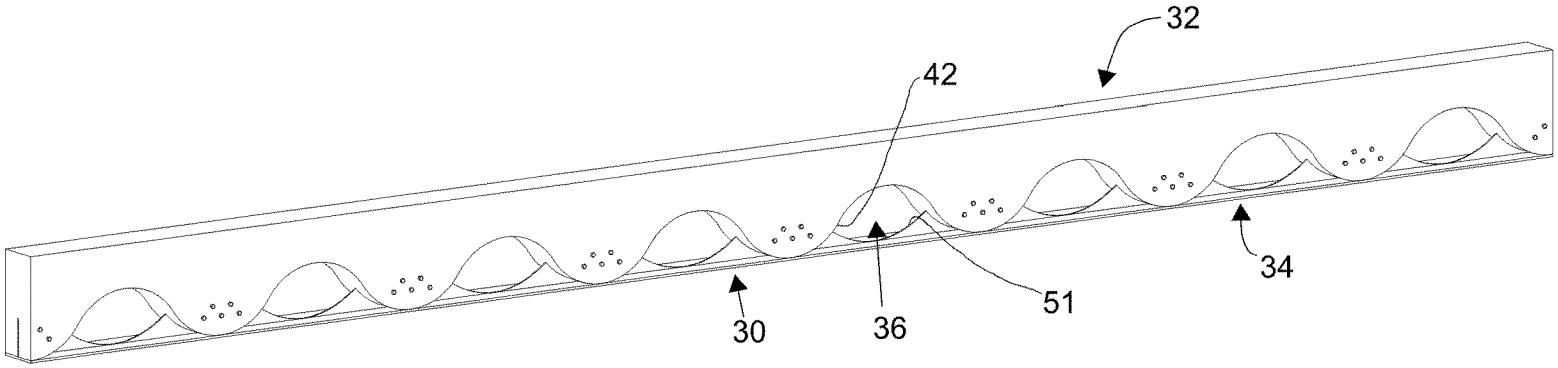
Figure 6B:
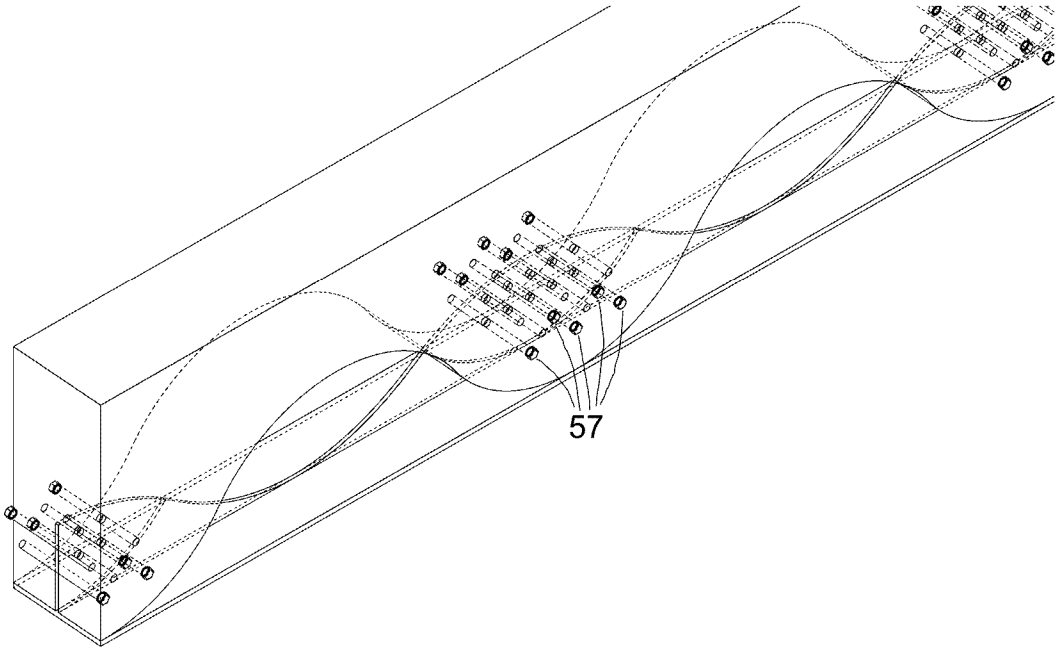
Figure 6A:
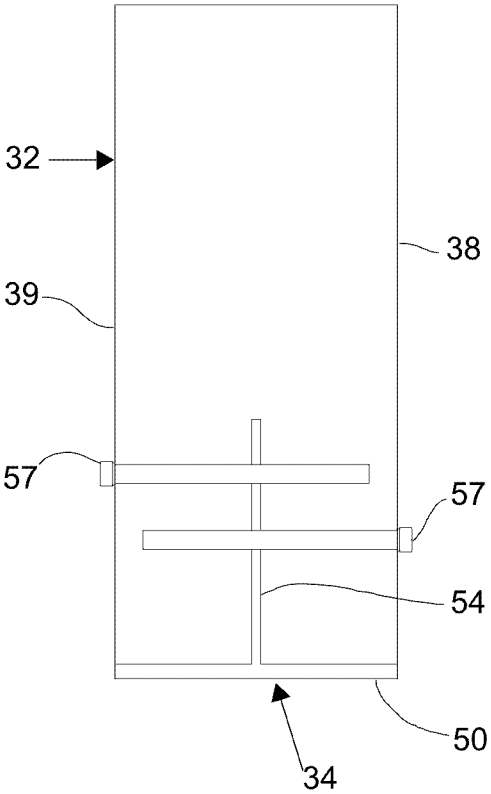
Figure 7:
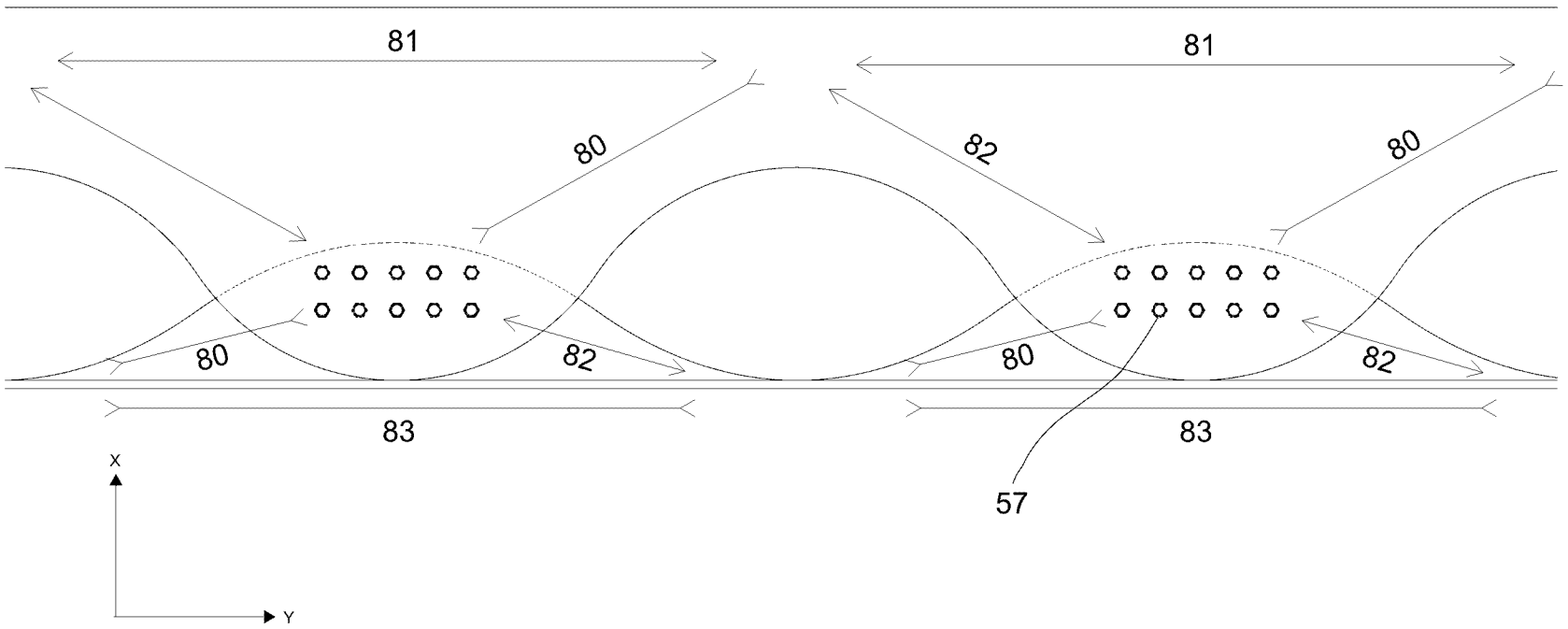
Figure 8A:
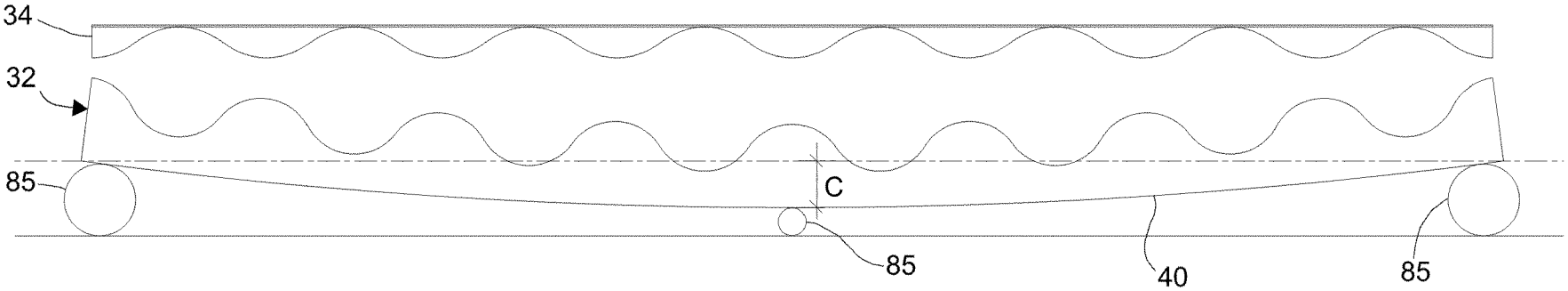
Figure 8B:
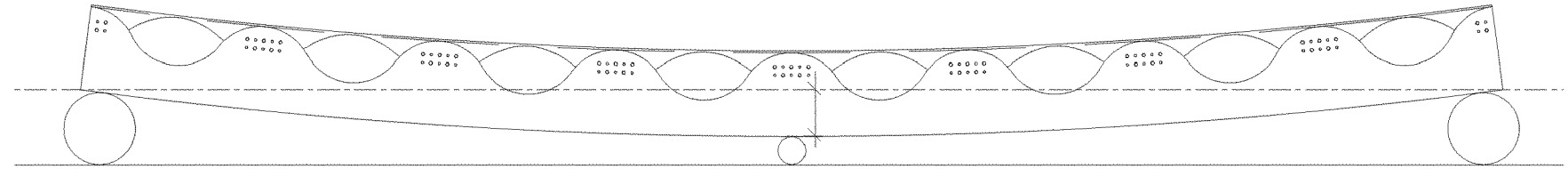
Figure 9A:
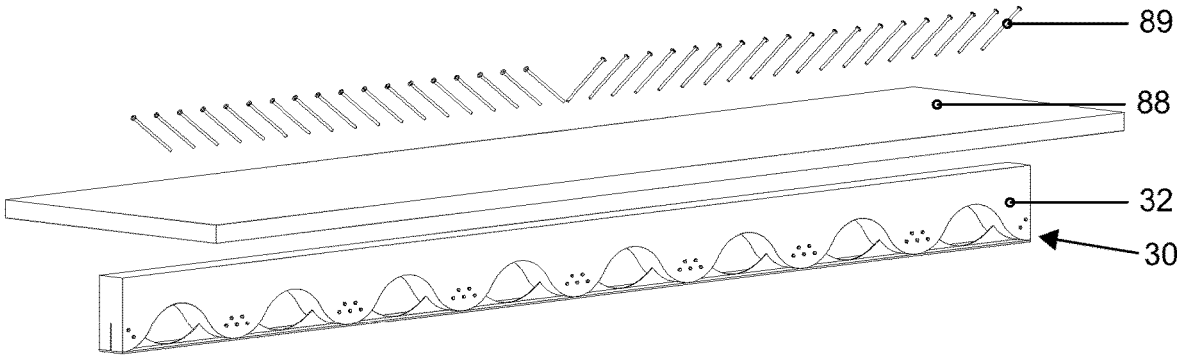
Figure 9B:
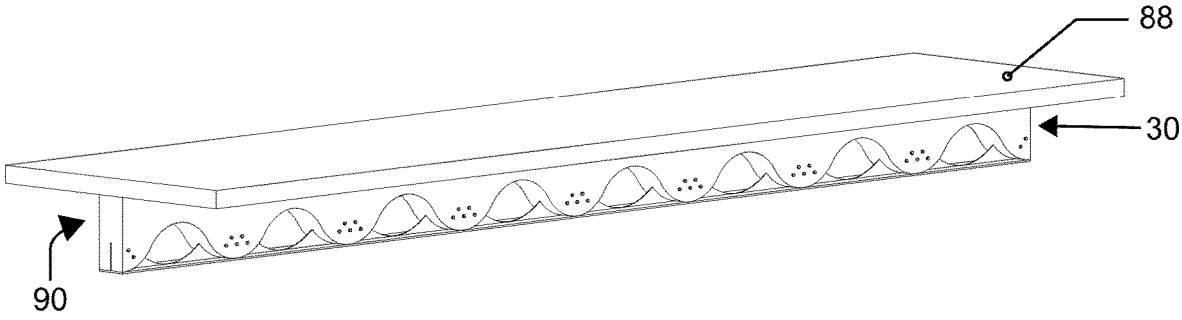
Figure 9C:
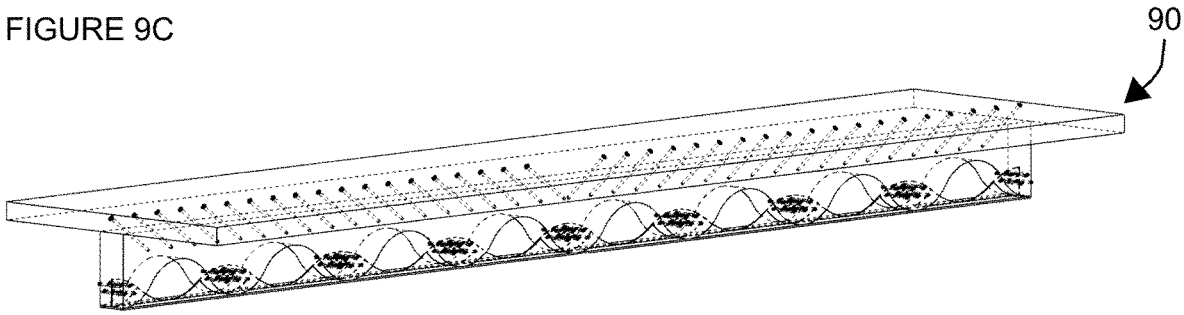
Figure 10:
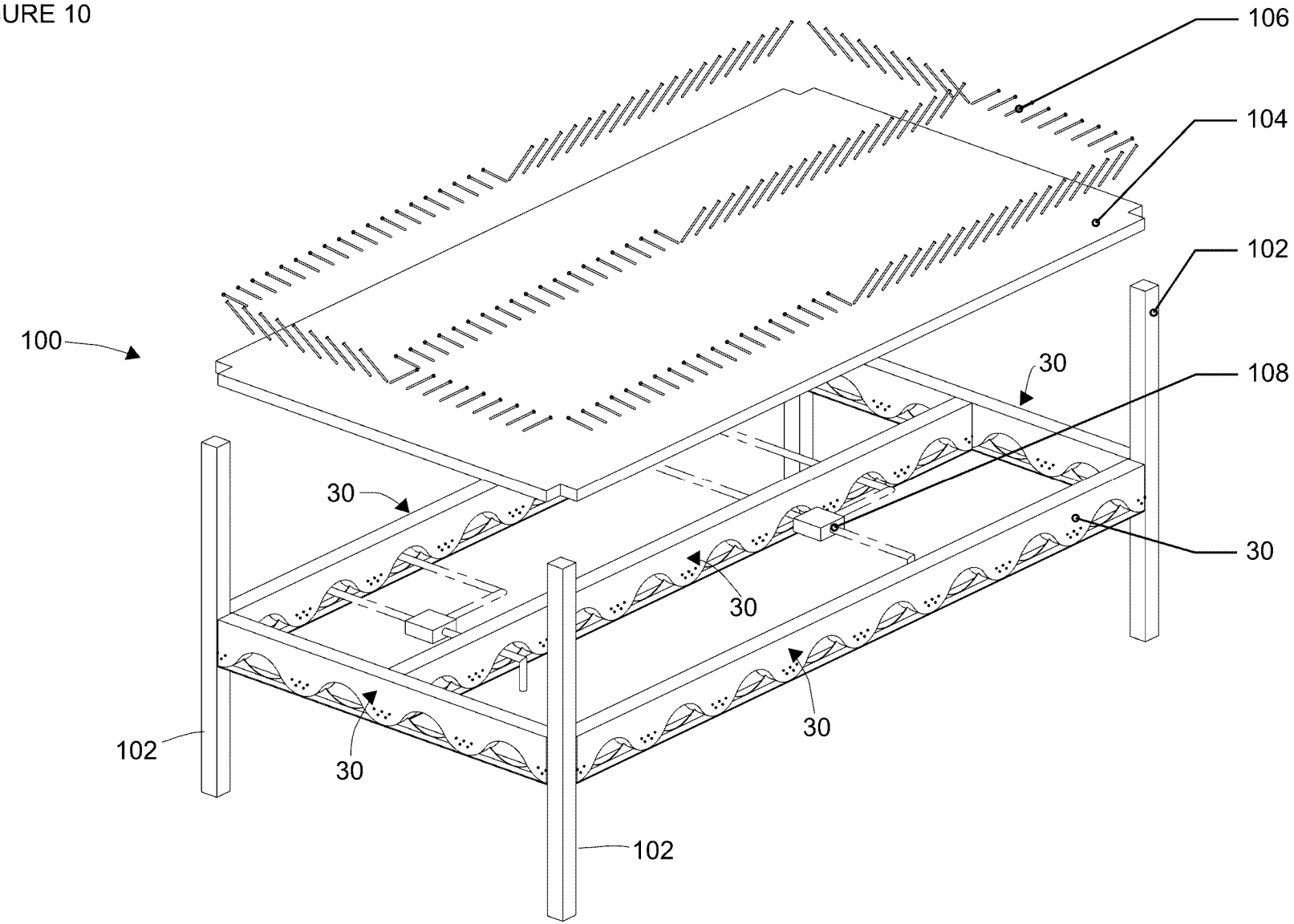
Figure 11A:
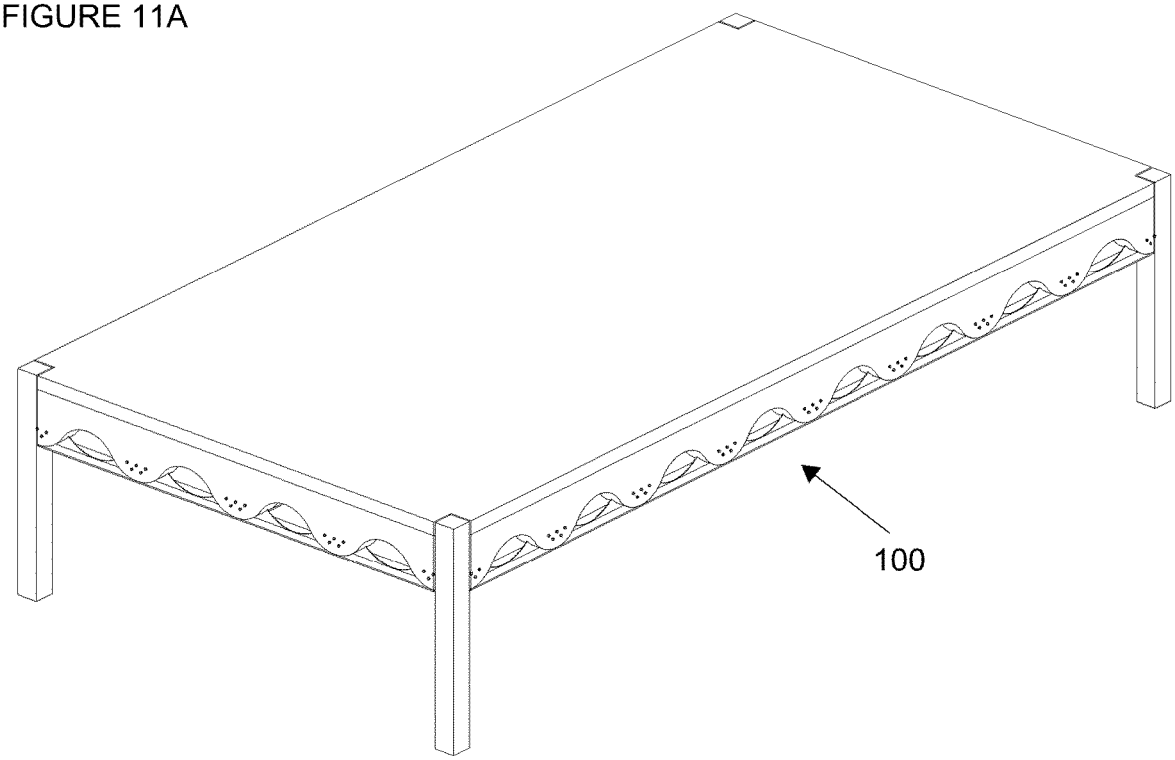
FIG. 11A shows the assembled floor assembly 100.
Figure 11B:
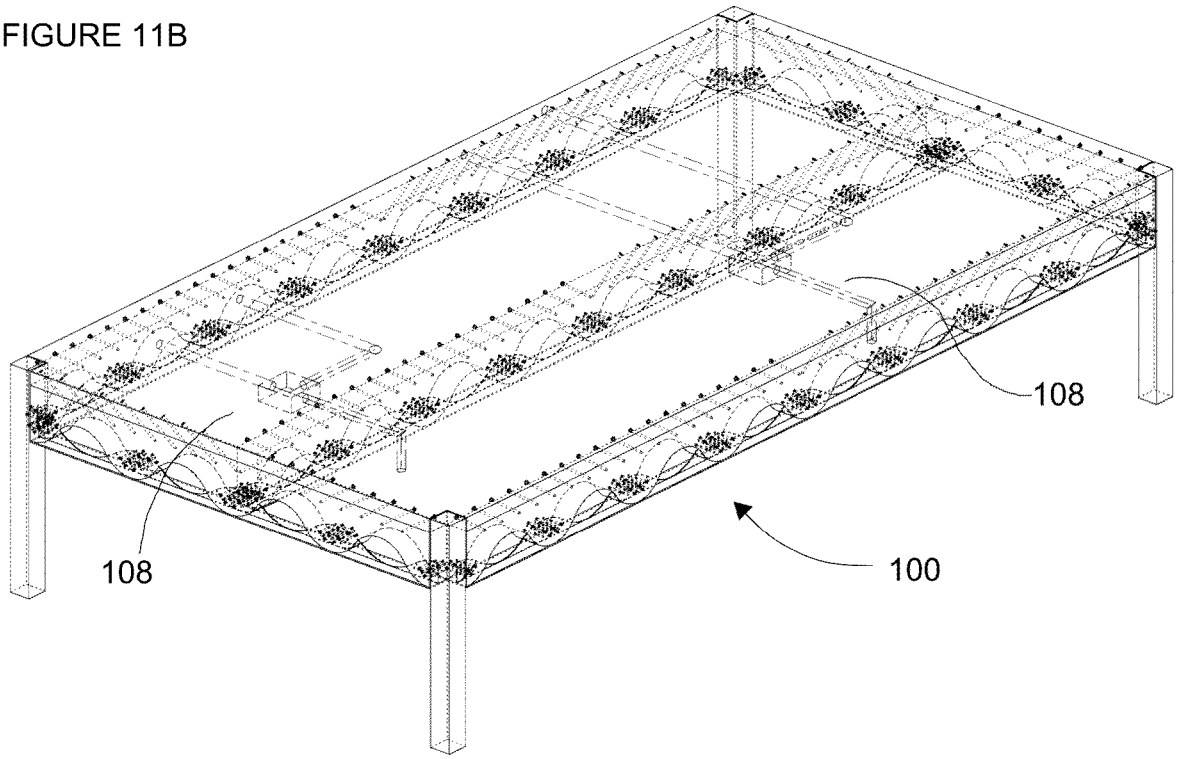
FIG. 11B shows the assembled floor assembly 100, and hidden elements including but not limited to services 108.
Figure 12A:
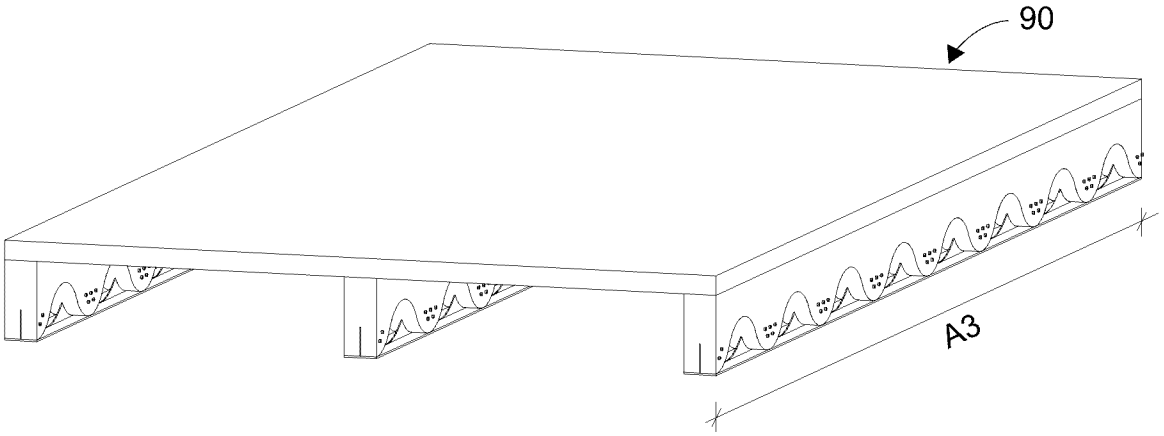
Figure 12B:
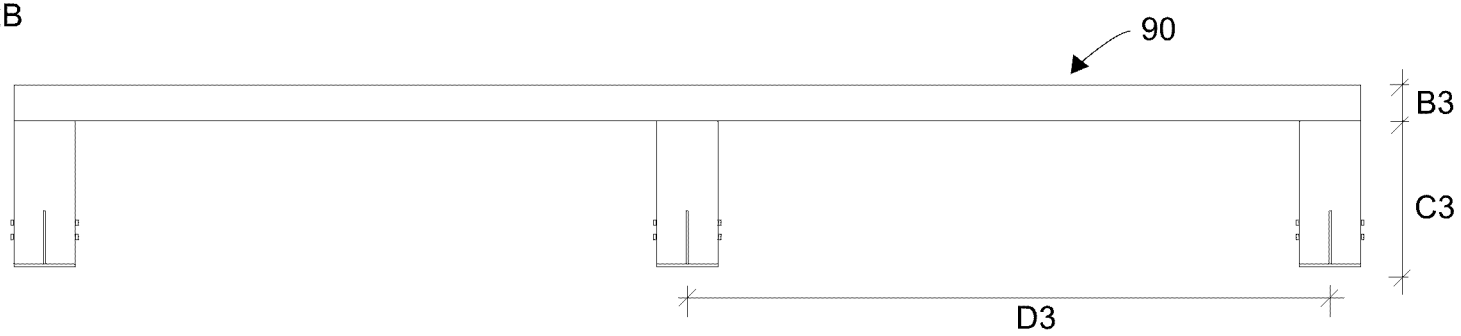
Figure 13A:
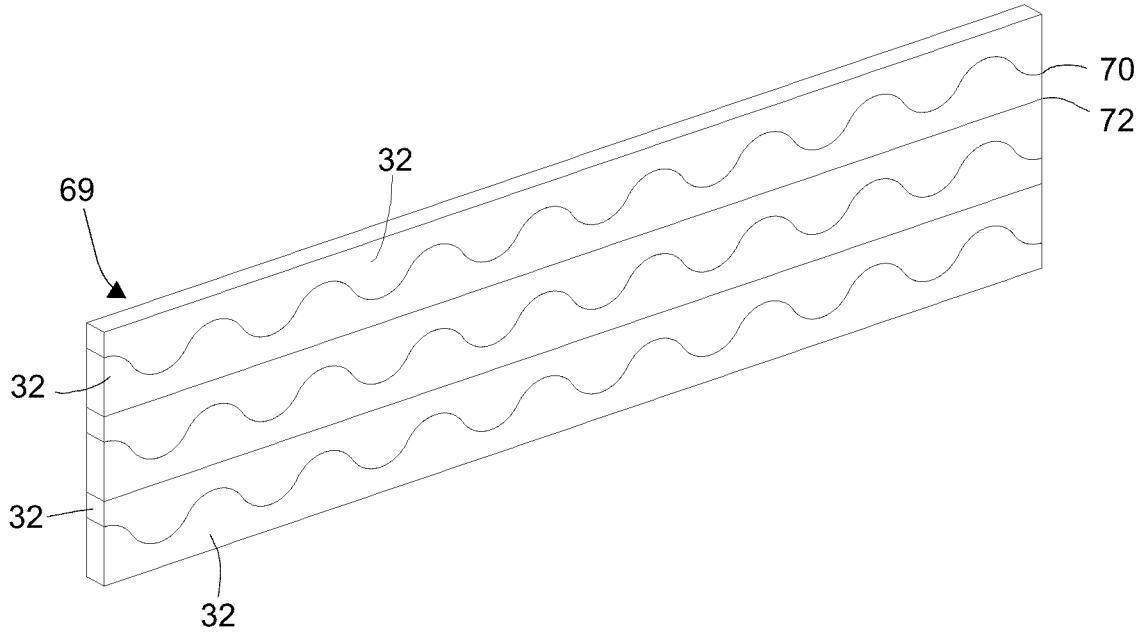
Figure 13B:
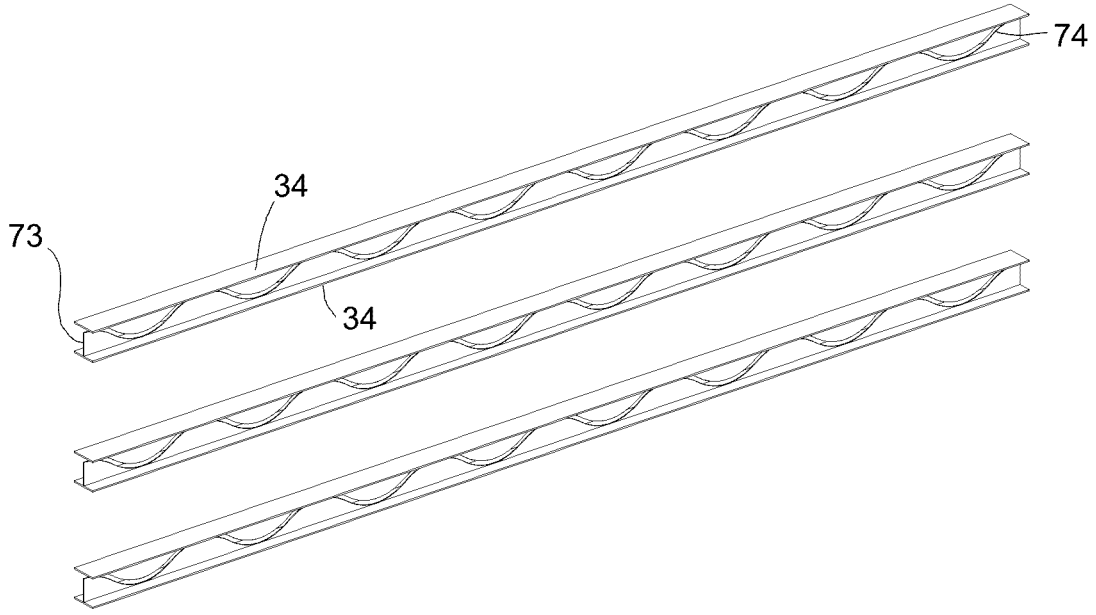
Figure 14A:
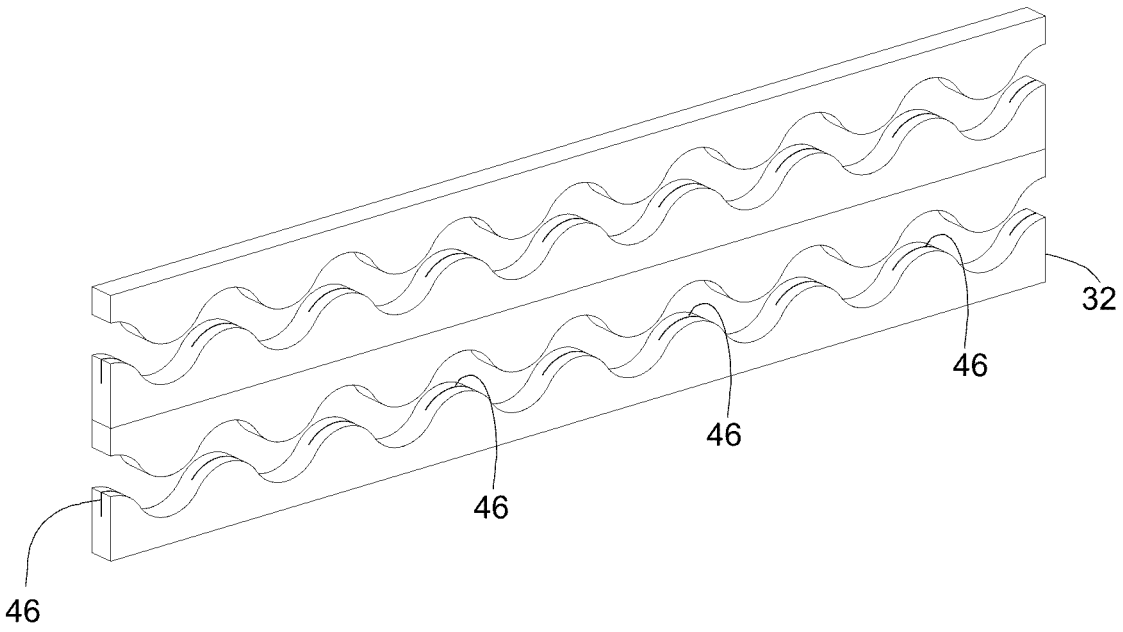
Figure 14B:
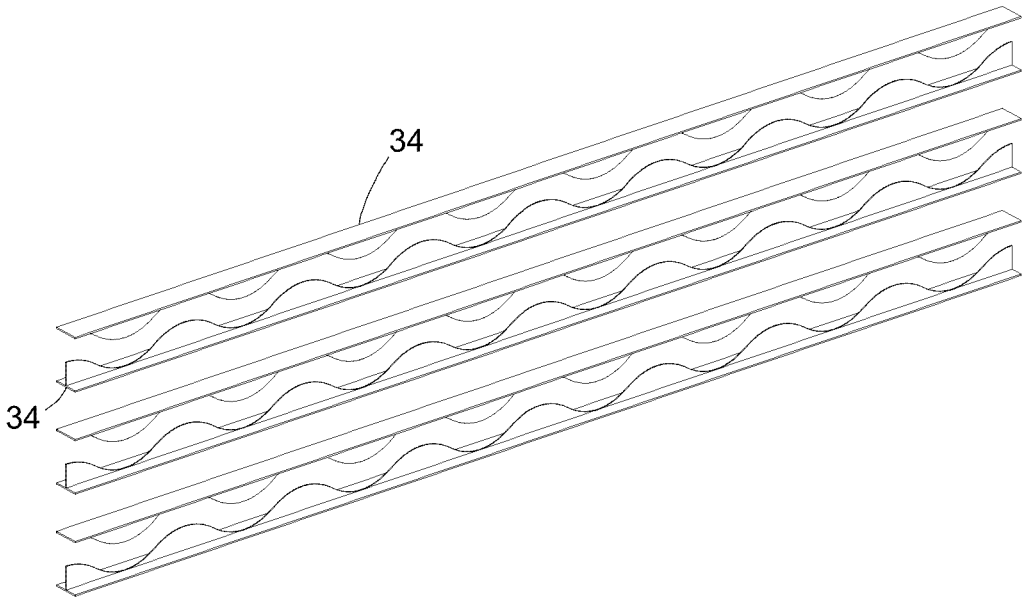
Figure 15A:
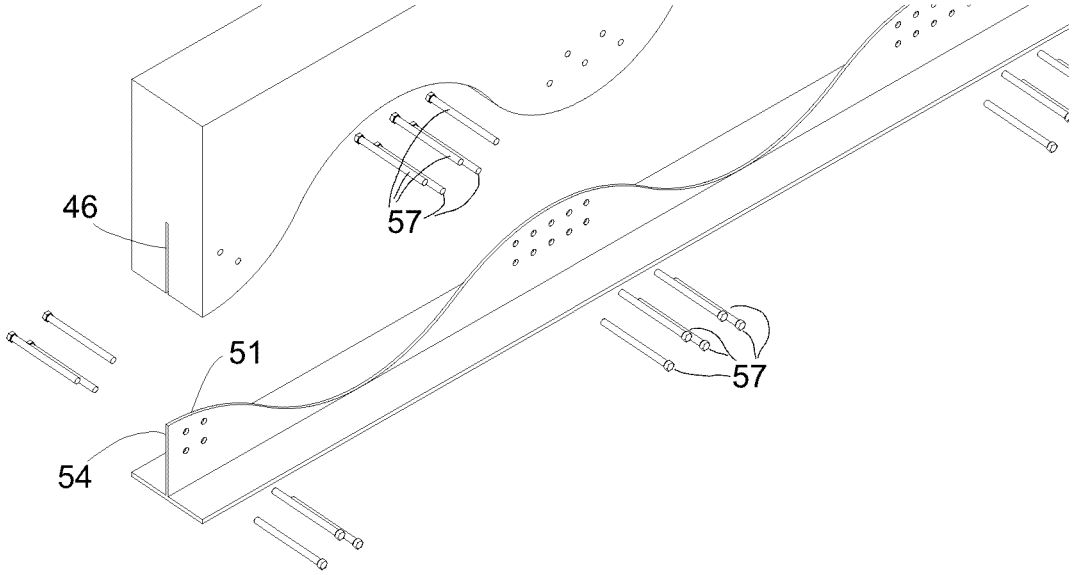
Figure 15B:
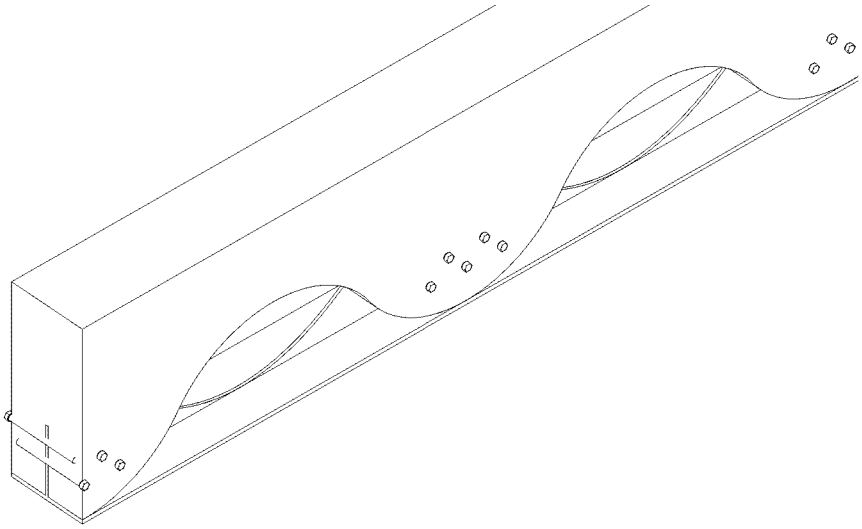

Referring to FIG. 12A, the typical span A3 of the composite floor panel assembly 90 is 9 to 15 metres (29.5 to 49.2 feet). Referring to FIG. 12B, the typical slab thickness B3 is 125 mm (4.92 inches) to 225 mm (8.86 inches). The typical beam depth C3 is 600 mm (23.62 inches) to 800 mm (31.49 inches). The typical distance from centre to centre of beam D3 is 1500 mm (59.06 inches) to 4500 mm (177.17 inches).

An advantage of the composite floor beam 30 is that services 108 (cabling and/or piping and/or other utilities) can run through the openings 36 in the hybrid beams 30.

The terms "composite" and "hybrid" are interchangeable. The term "timber" is interchangeable with the term "wood".

In another embodiment of the invention (not shown for conciseness), a further composite floor beam comprises either an irregular lower surface of the upper part 32, or an irregular upper surface of the lower part 34, both need not be irregular.

For conciseness and/or clarity, not all identical or similar parts are referenced in the drawings.

The invention claimed is:

1. A composite floor beam configured for use in a workpiece structure having at least one floor and at least one ceiling and utilities therein, the composite floor beam comprising:

an upper part composed of wood, the upper part extending substantially along a length of the beam; and a lower part composed of steel, the lower part extending substantially along the length of the beam, wherein the upper part comprises an upper surface and a lower surface, wherein the lower part comprises an upper surface and a lower surface, wherein the upper surface of the upper part is configured to be positioned horizontally to support the workpiece floor above, wherein the upper surface of the upper part is parallel to the lower surface of the lower part, wherein the lower surface of the lower part is configured to be positioned horizontally for attachment to the workpiece ceiling below, wherein at least one of (i) the lower surface of the upper part has an irregular shape defined by a non-uniform distance extending between the lower surface of the upper part and the upper surface of the upper part that varies along an entire length of the upper part, and (ii) the upper surface of the lower part has an irregular shape defined by a non-uniform distance extending between the upper surface of the lower part and the lower surface of the lower part that varies along an entire length of the lower part, and wherein the lower surface of the upper part and the upper surface of the lower part define apertures therebetween for the workpiece utilities, the apertures passing from a first side of the beam to a second side of the beam transverse to a direction of the length of the beam and between distal ends of the beam.

2. The composite floor beam according to claim 1, characterised in that both the lower surface of the upper part has the irregular shape, and the upper surface of the lower part has the irregular shape.

3. The composite floor beam according to claim 2, wherein the apertures are defined between the irregular lower surface of the upper part and the irregular upper surface of the lower part.

4. The composite floor beam according to claim 2, wherein the irregular shape of the lower surface of the upper part is a waveform shape and wherein the irregular shape of the upper surface of the lower part is a waveform shape.

5. The composite floor beam according to claim 2, wherein a plurality of lowest points on the lower surface of the upper part comprises an upstanding slot running in a direction of a length of the upper part.

6. The composite floor beam according to claim 1, wherein the lower part has a horizontally aligned part and an upstanding member running along at least part of a length of the horizontally aligned part.

7. The composite floor beam according to claim 6, wherein the upper surface of the upstanding member of the lower part is shaped as a wave.

8. The composite floor beam according to claim 7, wherein the upstanding member of the lower part engages with an upstanding slot of the upper part.

9. The composite floor beam according to claim 6, wherein the irregular lower surface of the upper part rests on the horizontally aligned part of the lower part.

10. The composite floor beam according to claim 9, further comprising tabs depending from the upper part and tabs upstanding from the lower part, wherein the depending tabs of the upper part are fastened-to the upstanding tabs of the lower part.

11. The composite floor beam according to claim 9, wherein ends of each upper part are identical in cross section.

12. The composite floor beam according to claim 9, wherein ends of each lower part are identical in cross section.

13. A floor panel assembly, comprising:

a composite floor beam according to claim 1, and a floor panel to which the upper surface of the upper part is joined.

14. The floor panel assembly of claim 13, further comprising a plurality of support columns joined to the floor panel.

15. A method of making the composite floor beam of claim 1, wherein the method comprises:

providing a piece of first material and a piece of second material, wherein the piece of first material is a cuboid piece of timber and the piece of second material is an I-section steel beam, and cutting each piece of material in the irregular shape, wherein each irregular shape is a waveform shape, about half way from an upper surface and a lower surface of each piece of material, varying according to a point thereon, so as to produce a pair of approximately similar first parts and a pair of approximately similar second parts, each of the first parts being usable as an upper part of the composite floor beam and each of the second parts being usable as a lower part of the composite floor beam.

16. The method of claim 15, wherein the method further comprises cutting at least one slot in a lower surface of the upper part.

17. The method of claim 15, wherein the method further comprises arranging an upstanding part of the lower part in the at least one slot in the lower surface of the upper part.

18. The method of claim 15, wherein the method further comprises releasably fastening the upper part to the lower part.

19. A method of installing a floor assembly, comprising:

providing a plurality of support columns and at least one floor panel;

joining a plurality of the composite floor beams of claim 1 to the support columns; and joining the at least one floor panel to the upper surface of the upper part of the composite floor beams.

* * * * *